US005742257A

United States Patent [19]

Hadden et al.

[11] Patent Number: 5,742,257

[45] Date of Patent: Apr. 21, 1998

[54] OFFSET FLARED RADIATOR AND PROBE

[75] Inventors: John M. Hadden, Redondo Beach; Anthony J. Fahey, Thousand Oaks; James P. Treinen, Playa del Rey, all of Calif.

[73] Assignee: Raytheon Company, Lexington, Mass.

[21] Appl. No.: 689,756

[22] Filed: Aug. 13, 1996

[51] Int. Cl.[6] ..... H01Q 13/10

[52] U.S. Cl. ..... 343/767; 343/860

[58] Field of Search ..... 343/767, 770, 343/795, 859, 860; H01Q 13/10, 13/20

[56] References Cited

U.S. PATENT DOCUMENTS

| | | | |
|---|---|---|---|
| 5,036,335 | 7/1991 | Jairam | 343/767 |
| 5,187,489 | 2/1993 | Whelan et al. | 343/767 |
| 5,194,875 | 3/1993 | Lucas | 343/767 |
| 5,264,860 | 11/1993 | Quan | 343/767 |
| 5,541,611 | 7/1996 | Peng et al. | 343/767 |

*Primary Examiner*—Michael C. Wimer

*Attorney, Agent, or Firm*—Glenn H. Lenzen, Jr.; Leonard A. Alkov

[57] ABSTRACT

An offset flared radiator and probe assembly for radiating and receiving electromagnetic energy. The radiator includes a reflective resonator which is nonsymmetrical to the radiator axis, and is coupled to the flare slotline region by a bend and transverse slotline region. The transverse slotline region is of sufficient length to accommodate a probe also offset from, and parallel to the radiator axis. The probe has no bends to cause reflections. The junction between the probe and the transverse slot region provides a coupling region for the energy received at the flared radiator.

12 Claims, 1 Drawing Sheet

OFFSET FLARED RADIATOR AND PROBE

TECHNICAL FIELD OF THE INVENTION

The present invention relates to flared radiator elements of the type used in radar array antennas for radiating and receiving electromagnetic energy.

BACKGROUND OF THE INVENTION

Conventional flared radiator and probe assemblies have used a resonator symmetrical about the radiator axis. A conventional configuration is illustrated in FIG. 1, and includes the flared radiator 10, a slotline region 12 and a resonator 14. The resonator 14 is symmetrical about the radiator axis 24. The probe 16 is a stripline buried in a channel within the metal slab from which the radiator is fabricated, and typically has one, or more typically three, bends 18, 20 and 22. Reflections from the probe with bends can introduce performance variations unless tolerances are very tightly controlled, which is costly and can make fabrication difficult.

Another known flared notch radiator and probe assembly employs an L-shaped probe which is offset from the radiator axis.

SUMMARY OF THE INVENTION

An offset flared radiator and probe apparatus for radiating and receiving electromagnetic energy is described. The apparatus includes a flared radiator comprising first and second electrically conductive flared regions which taper toward a first slotline region, defining a first slotline region extending generally along a radiator axis. A transverse slotline region extends transversely to the first slotline region, the transverse and first slotline regions meeting at a slotline bend. An offset reflective resonator comprising a resonator cavity is defined in the first flared region, and is disposed nonsymmetrically with respect to the radiator axis. The transverse slotline region terminates at the resonator. An offset probe extends generally parallel to and offset from the radiator axis, transversely to the transverse slotline region at a coupling junction. Electromagnetic energy is coupled between the flared slotline regions and the probe.

Because the probe conductor is without sharp bends, losses due to discontinuities in the probe conductor are minimized. Due to the offset of the resonator, the assembly is more compact and shorter than conventional radiator designs.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 2:
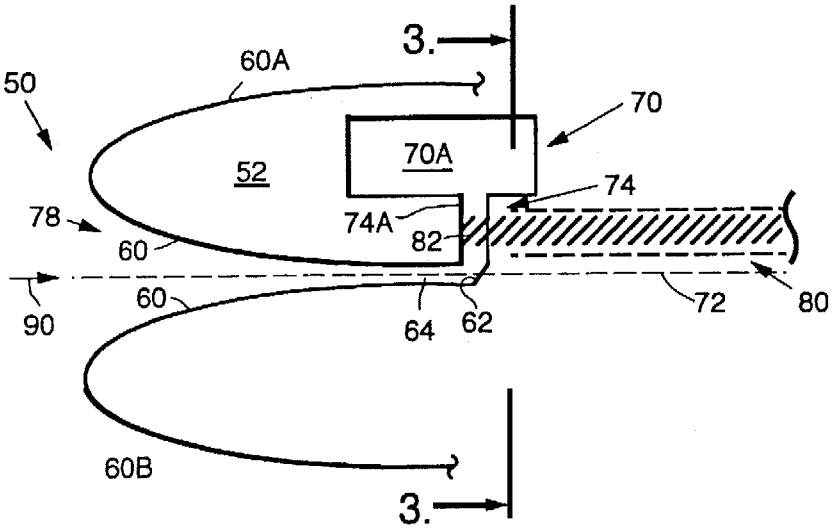
FIG. 2 is a top view illustrating a first embodiment of a flared radiator and probe embodying the invention.

An offset flared radiator and probe assembly 50 in accordance with the invention is shown in the top view of FIG. 2.

The assembly includes a flared radiator 60, typically of a metal or metal clad construction, which includes first and second flared regions 60A and 60B. The wide area 78 between the first and second flared regions narrows to the slotline region 64. In accordance with the invention, the assembly 50 further includes an offset resonator 70 defined in the flared region 60A which is not symmetrical with the axis 72 of the flared radiator. The resonator is an open region 70A defined in the metal or metal-clad construction of the flared area 60A, and communicates with the slotline region 64 via a second slotline region 74. The second slotline region 74 meets and communicates with the first slotline region 64 at bend 62. The bend 62 may be a mitered bend as shown, a double-mitered bend wherein the inside corner is also mitered, or a radiused bend. The resonator 70 and the first and second slotline regions 64 and 74 are open regions or channels which extend through the metal slab or metal-clad material, indicated generally as element 52 (FIG. 2), from which the flared notch radiator is fabricated.

It will be appreciated that the invention can be implemented with flared notch radiators which employ thick slotline or thin slotline construction.

The probe 80 is a conductive strip circuit element which is also offset from the axis 72 of the assembly, and in this exemplary embodiment extends generally parallel to the axis in the region of the resonator 70. In this exemplary embodiment, the second slotline region 74 has sufficient length in relation to the width of the probe 80 that the probe extends between the resonator and the slotline region 64 without overlapping the resonator cavity 70A. In other applications, the probe may be designed to overlap the resonator.

Figure 1:
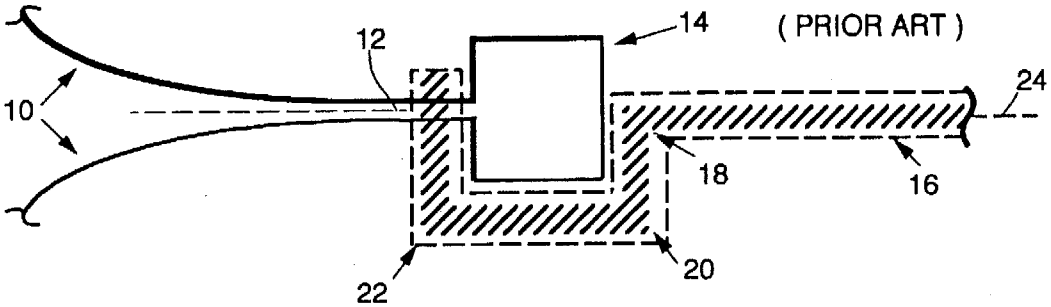
FIG. 1. (PRIOR ART)
FIG. 1 is a schematic diagram showing a conventional flared radiator element with probe.
Figure 3:
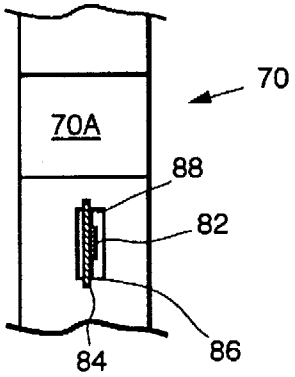
FIG. 3 is a cross-sectional view of the flared notch and probe shown in FIG. 2, taken along line 3—3 of FIG. 2.

FIG. 3 is a cross-sectional view taken along line 3—3 of FIG. 2, showing in further detail the probe 80. In this embodiment, the probe is a stripline circuit which comprises a stripline center conductor 82 formed on a dielectric substrate 84. The substrate and center conductor reside within an open channel 88 formed in the metal slab 52, with the channel walls defining the stripline circuit outer conductor 86. The substrate 84 and center conductor 82 extend through the open channel, into the second slotline region 74 to the wall 74A of the slotline region 74. The center conductor 82 makes electrical contact with the metal wall 74A in this embodiment.

The assembly 50 receives an electromagnetic wave 90 from the wide opening 78 of the flared radiator 60. Most of the wave travels inward toward the slotline region 64, through the bend 62, and upon crossing the probe junction 88, is coupled into the probe 80. Little energy is absorbed by the resonator, which can be deliberately reflective to maximize coupling into the probe, i.e., the advantage to having the resonator reflective is to avoid absorbing energy in the resonator. The received wave energy coupled into the probe 80 proceeds along the probe until it is accepted by a power division network, connector, or other well known component, not shown in FIG. 2.

Portions of the received wave are reflected at each discontinuity along its path in the assembly 50, and are later re-radiated outwardly. These reflections can be minimized by appropriate design of the assembly, using techniques well known to those skilled in the art.

Figure 4:
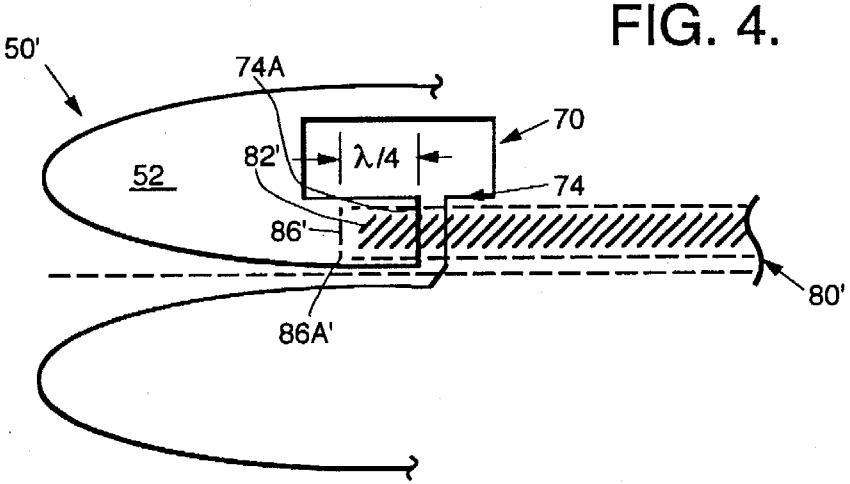
FIG. 4 is a top view illustrating a second embodiment of a flared radiator and probe embodying the invention.

FIG. 4 illustrates a simplified top view of an alternative embodiment of the invention. The flared notch and probe assembly 50' are similar to the assembly 50 of FIGS. 2 and 3, except that the probe 80' extends through the second slotline region 74 into a channel extension 86' of the channel which carries the probe formed in the slab 52. The end of the probe center conductor 82' does not contact the conductive wall 86A' in this embodiment. The wall 86' is disposed a distance of approximately ¼ wavelength from the wall 74A of the slotline region, as shown in FIG. 4. In some applications, the axis of the probe conductor and/or resonator need not be parallel to the radiator axis, but may be rotated somewhat, e.g. in the embodiment of FIG. 4, to provide clearance of the probe end away from the edge of the flared region. A slight bend in the probe conductor may also be employed to accomplish the same function.

The offset flared radiator and probe assembly according to this invention can be advantageously employed to form an array of radiating elements. Alternatively, the radiator and probe assembly can be used in applications requiring only a single radiating element. While the flared regions can be formed by curved tapers as shown in FIG. 2, alternatively the flared regions can be formed by linear tapers or stepped tapering. The flared regions need not be formed by continuous metal surfaces, but alternatively by open wire construction.

The offset flared radiator and probe assembly of this invention provides a number of advantages. The assembly provides fewer bends in the probe to reflect electromagnetic energy, so that less power is lost, and is easier and cheaper to fabricate and assemble than conventional flared radiators. Tolerance accumulation during assembly affects consistency of performance less than in accumulation in assembly of conventional devices. Axial and transverse displacements of the probe relative to the radiator during manufacture degrade the performance less than axial and transverse displacements of the probe in conventional radiator assemblies. The radiator and probe assembly is more compact, lighter, less expensive and shorter than conventional assemblies. The simplified probe design of the invention reduces the probe design cycle time and cost. The reduced depth and weight of the radiator and probe assembly is advantageous when space is limited, e.g. in conformal installations. The reduced sensitivity to tolerances will reduce recurring fabrication and assembly costs.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An offset flared radiator and probe apparatus for radiating and receiving electromagnetic energy, comprising:

a flared radiator comprising first and second electrically conductive flared regions which taper toward a first slotline region extending generally along a radiator axis, wherein the flared radiator is formed of an electrically conductive slab member;

a transverse slotline region extending transversely to the first slotline region, the transverse and first slotline regions meeting at a slotline bend;

an offset reflective resonator comprising a non-circular resonator cavity defined in said first flared region, said transverse slotline region terminating at said resonator, said resonator disposed nonsymmetrically with respect to said radiator axis; and an offset probe offset from the radiator axis, said probe extending transversely to said transverse slotline region at a coupling junction, the offset probe including a probe conductor having no bends formed therein, thereby reducing reflections of the electromagnetic energy propagating along the offset probe, disposed within a channel formed in the conductive slab member and extending parallel to the radiator axis, wherein electromagnetic energy is coupled between the transverse slotline region and the probe;.

wherein said transverse slotline region is of a predetermined length in relation to the width of said probe so that the probe extends between the resonator and the first slotline region.

2. The apparatus of claim 1 wherein the probe comprises a stripline transmission line, said line including a stripline conductor.

3. The apparatus of claim 1 wherein the probe conductor intersects said transverse slotline region and is electrically connected to a conductive wall defining said transverse slotline region.

4. The apparatus of claim 1 wherein the probe conductor intersects said transverse slotline region and is not electrically connected to a conductive wall defining said transverse slotline region.

5. The apparatus of claim 1 wherein said probe conductor intersects said transverse slotline region and extends into a buried channel extension formed in said slab member with a channel extension end forming an opening at a slab member wall defining a wall of said transverse slotline region, wherein said probe conductor does not make electrical contact with said slab member.

6. The apparatus of claim 5 wherein said channel extension has a length equal to approximately one quarter wavelength at a frequency of operation of the apparatus.

7. An offset flared radiator and probe apparatus for radiating and receiving electromagnetic energy, comprising:

a flared radiator comprising first and second electrically conductive flared regions which taper toward a first slotline region extending generally along a radiator axis between the flared regions, wherein the flared radiator is formed of an electrically conductive slab member;

a transverse slotline region extending transversely to the first slotline region, the transverse and first slotline regions meeting at a slotline bend;

an offset reflective resonator comprising a non-circular resonator cavity defined in said first flared region, said transverse slotline region terminating at said resonator, said resonator disposed nonsymmetrically with respect to said radiator axis; and an offset probe comprising a linear conductor extending parallel to said and offset from the radiator axis, said probe conductor extending transversely to said transverse slotline region and above the transverse slotline region at a coupling junction, wherein the probe conductor does not overlap the resonator cavity, wherein the probe conductor has no bends formed therein, thereby reducing reflections of the electromagnetic energy propagating along the probe, disposed within a channel formed in the conductive slab member and extending parallel to the radiator axis, and wherein electromagnetic energy is coupled between the transverse slotline region and the probe;.

wherein said transverse slotline region is of a predetermined length in relation to the width of said probe so that the probe extends between the resonator and the first slotline region.

8. The apparatus of claim 7 wherein the probe comprises a stripline transmission line, said line including a stripline conductor.

9. The apparatus of claim 7 wherein the probe conductor intersects said transverse slotline region and is electrically connected to a conductive wall defining said transverse slotline region.

10. The apparatus of claim 7 wherein the probe conductor intersects said transverse slotline region and is not electrically connected to a conductive wall defining said transverse slotline region.

11. The apparatus of claim 7 wherein said probe conductor intersects said transverse slotline region and extends into a buried channel extension formed in said slab member with a channel extension end forming an opening at a slab member wall defining a wall of said transverse slotline region, wherein said probe conductor does not make electrical contact with said slab member.

12. The apparatus of claim 10 wherein said channel extension has a length equal to approximately one quarter wavelength at a frequency of operation of the apparatus.

* * * * *